US006409077B1

(12) United States Patent
Telesca et al.

(10) Patent No.: US 6,409,077 B1
(45) Date of Patent: Jun. 25, 2002

(54) DISPLAY CARTON

(75) Inventors: Josephine Telesca, Trumbull; Michael Edward Ross, Oxford, both of CT (US)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 30 days.

(21) Appl. No.: 09/713,469

(22) Filed: Nov. 15, 2000

Related U.S. Application Data

(60) Provisional application No. 60/202,944, filed on May 9, 2000.

(51) Int. Cl.[7] ..... B65D 5/54

(52) U.S. Cl. ..... 229/164; 206/45.29; 229/117; 229/240

(58) Field of Search ..... 229/117, 164, 229/240, 242; 206/45.29, 746, 756, 757, 759, 760, 774, 494, 812

(56) References Cited

U.S. PATENT DOCUMENTS

| | | | | | |
|---|---|---|---|---|---|
| 1,800,550 | A | * | 4/1931 | Mahoney, Jr. et al. | 206/45.29 |
| 3,219,181 | A | * | 11/1965 | Dahm | 206/45.29 |
| 3,669,251 | A | * | 6/1972 | Phillips, Jr. | 206/756 |
| 4,095,735 | A | * | 6/1978 | Stone | 229/117 |
| 4,363,400 | A | * | 12/1982 | Lewis | 229/240 |
| 4,553,666 | A | * | 11/1985 | Gullikson | 229/240 |
| 4,886,160 | A | * | 12/1989 | Kligerman | 206/746 |
| 5,664,726 | A | * | 9/1997 | Opper | 229/117 |
| 5,979,749 | A | * | 11/1999 | Bozich | 229/164 |
| 5,996,797 | A | * | 12/1999 | Flaig | 206/494 |
| 6,135,289 | A | * | 10/2000 | Miller | 206/774 |

FOREIGN PATENT DOCUMENTS

WO 01/34483 5/2001

OTHER PUBLICATIONS

Blueprint of Pond's® tray—Feb. 14, 1999.

* cited by examiner

*Primary Examiner*—Gary E. Elkins
(74) *Attorney, Agent, or Firm*—Milton L. Honig

(57) ABSTRACT

A collapsible carton for shipping, storage and display of individually wrapped smaller packages is provided which includes opposing front and rear panels, a floor and a pair of opposing side panels. The front, rear and side panels have walls of identical height as measured from the floor up to an upper edge of each of the panels. Together they form a receiving cavity with the edges defining an open mouth. Each side panel includes a tear-away section shaped preferably as a right triangle, one edge of the tear-away section being coincident with the upper edge of the respective side panel and a diagonal edge in perforated attachment running transverse across the side panel. The front panel also includes a tear-away section having one edge coincident with the upper edge of the front panel and an opposed edge in perforated attachment. Cartons of this invention are particularly suited for individually wrapped personal care products such as towelettes which are elongate and cannot easily be stood by themselves on a market shelf.

7 Claims, 3 Drawing Sheets

DISPLAY CARTON

This application claims benefit of provisional application Ser. No. 60/202,944 filed May 9, 2000.

BACKGROUND OF THE INVENTION

1. Field of the Invention

The invention relates to an aesthetic shelf display tray or carton for holding individually packaged products, especially a tray built with compression strength features requiring less secondary protective packaging during transport.

2. The Related Art

Display trays for individually packaged personal care and other items have traditionally been produced in their final use form. Once removed from protective outer packaging, the trays filled with product need no further assembly for placement onto a store shelf. Ordinarily trays are shipped to the store in larger cartons fashioned with corrugated pads and other protective structures to provide compression strength and stability during shipment or storage. The additional packaging increases overall cost. It would be desirable to fashion a system requiring less secondary protective packaging.

Accordingly, it is an object of the present invention to provide a tray or carton for displaying multiple individually wrapped identical products wherein the tray has structures which function to improve compression strength and containment of products during shipping.

Another object of the present invention is to provide a shelf tray or carton in paperboard-form for displaying multiple individually wrapped identical products formed from a single paperboard blank which has panels serving as secondary protective structures during shipping and storage.

SUMMARY OF THE INVENTION

A display carton which includes:

opposing front and rear panels;

a floor defined by at least one panel;

a pair of opposing side panels;

the front, rear and side panels having walls of identical height as measured from the floor up to an upper edge of the panel, the panels forming a receiving cavity and the upper edges defining an open mouth, the side panels each including a tear-away section shaped preferably as a right triangle, one edge of the tear-away section being coincident with the upper edge of the respective side panel and a diagonal edge in perforated attachment running transverse across the side panel, and the front panel also including a tear-away section having one edge coincident with the upper edge of the front panel and having an opposed edge in perforated attachment.

In a first embodiment, the opposed edge of the front panel tear-away section defines a straight cut line. Another embodiment features the opposed edge as a non-linear perforated attachment.

The collapsible carton is particularly suited to contain a set of small individually wrapped packages. Personal care product packages are especially suitable for display cartons according to the present invention. One use of the carton is for holding flexible, soft wrapped personal care goods such as a stack of towelettes. Generally a product of this type includes a stack of from about 5 to about 30 individual woven or non-woven cellulosic or plastic wiping articles which may be interlaced with adjacent ones of this article. These wiping articles may either be impregnated with a cleansing fluid (such as water and surfactant and/or skin conditioner) or substantially dry (less than 30% water) impregnated with surfactant and/or conditioning agent actives. Whatever the type, the wiping articles are enveloped in a packaging including a flexible outer wrap of plastic foil ordinary heat-sealed along seams or openings. Typical foils include polyolefins, polyethylene terephthalate (e.g. Mylar®), aluminum metalized film or any combinations thereof. Normally these packages have insufficient rigid structure to stand alone on a store shelf. Anywhere from 3 to 20 of such packages may be supported within the display carton of the present invention.

Another type of personal care product package having instability is a triangular shaped carton of relatively rigid paperboard construction but being relatively unbalanced because of its lightweight contents. Typical of such triangular packages is Pond's® Overnight Blemish Reducers package which delivers a set of anti-acne adhesive dots positioned on a lightweight support sheet.

BRIEF DESCRIPTION OF THE DRAWING

The various objects, features and advantages of the present invention will become more readily apparent to those skilled in the art upon consideration of the following drawing in which.

DETAILED DESCRIPTION OF THE INVENTION

Now there is provided a paperboard shelf tray for holding from about 3 to about 20 individual product items requiring display and support. The tray exhibits sufficient compression strength and containment for shipping purposes. Simultaneously it serves at point-of-sale as a display carton upon removal of an easily detachable tear-away section. Four full-size panels are present to contain the product and protect the product from damage during shipment. Three of those panels contain perforations that allow for easy removal to form the display tray on the shelf. Also present is a self-locking group of bottom panels forming a floor to allow for sufficient set-up of the carton on a manufacturing line. Fold-in tabs on each side of the panel allow for full support of unstable items within the tray when on the shelf. These unstable items through presence of the tabs are hindered from falling forward out of the tray when displayed. Panels are preferably manufactured from but not necessarily limited by such materials as solid bleached sulphate board, Kraft paper, clay coated newsboard or any other paper stock, in various thicknesses. The only requirement must be of a material sufficiently strong to provide compression, while also flexible enough to tear easily.

Figure 1:
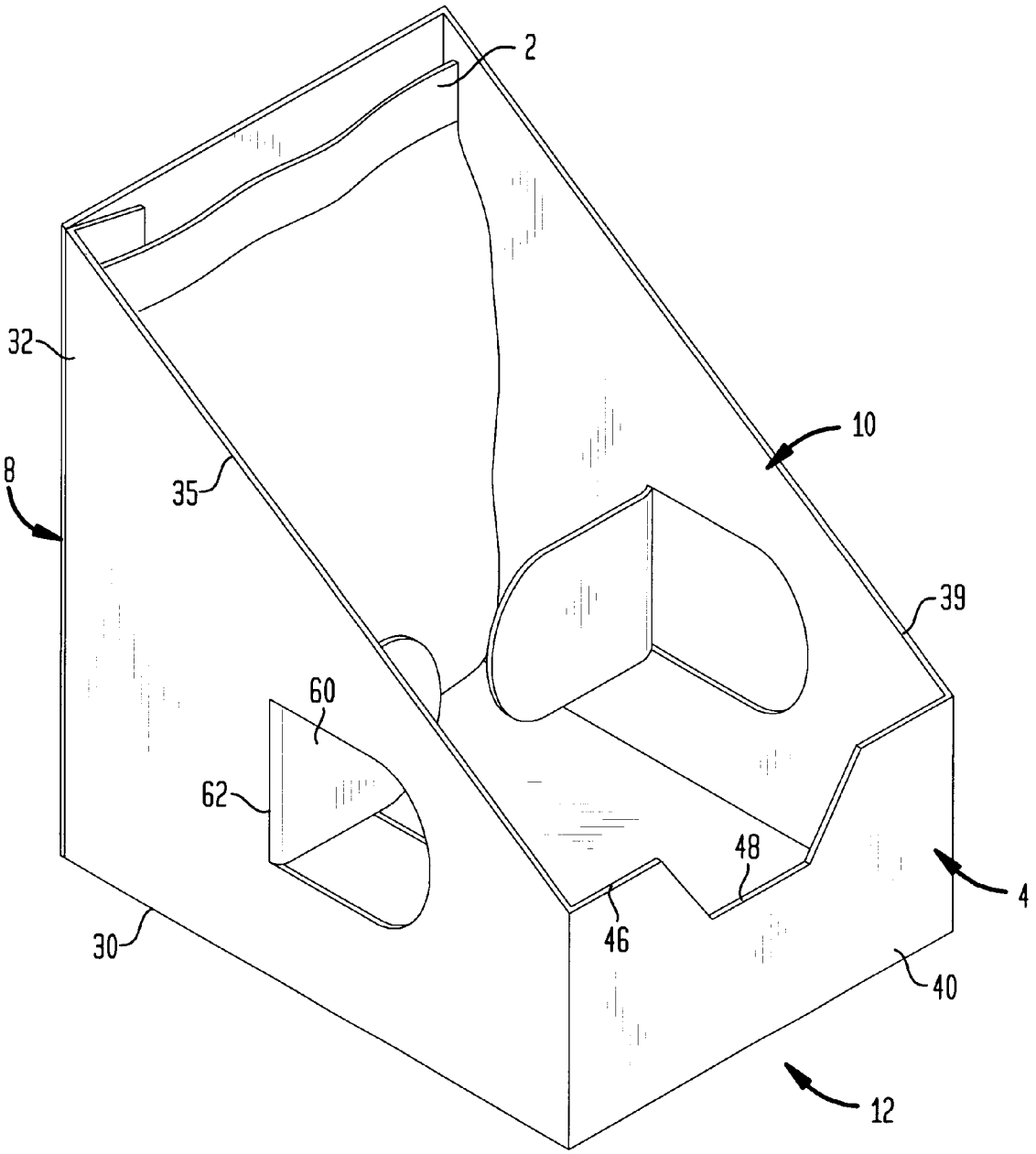
FIG. 1 is a plan perspective view of a display carton according to the present invention.

FIG. 1 illustrates the assembled carton shelf ready for display of individually packaged personal care products 2. The carton is formed from opposing front panel 4 and rear panel 6 parallel to one another. These are joined by a pair of opposing side panels 8, 10 parallel to one another and orthogonal to the front and rear panels.

A floor 12 is constituted from two pair of interlocking bottom panels which include a left and right gusseted panel 14, 16 and a left and right engagement panel 18, 20. Each of the gusseted panels has a respective score line 22, 24 and an engagement notch 26, 28 respectively cut within a generally rectangular or square gusseted panel. Score line 22 runs diagonally from notch 26 terminating near a terminus of a fold line 30, the latter defining a border between the left gusseted panel 14 and side panel 8. In similar manner score line 24 traverses from notch 28 to a corner of right gusseted panel 16 near fold line 31, the latter defining a border between the right gusseted panel 16 and side panel 10.

Side panel 8 includes a display wall section 32 and a tear-away section 34 separated along a perforation line 35. Likewise, right side panel 10 includes a display wall section 36 and a tear-away section 38 separated along a perforation line 39.

Front panel 4 includes a display wall section 40 and a tear-away section 42. These sections are separatable along perforation line 44. The perforation on the front panel may either be straight across or non-linear. The illustrated embodiment features a non-linear arrangement with perforation line 44 including horizontal line portions 46 at either terminus parallel to the floor separated along a middle section by a trough section 48 allowing for easier finger entry into the carton to extract a unit of packaged product.

Figure 2:
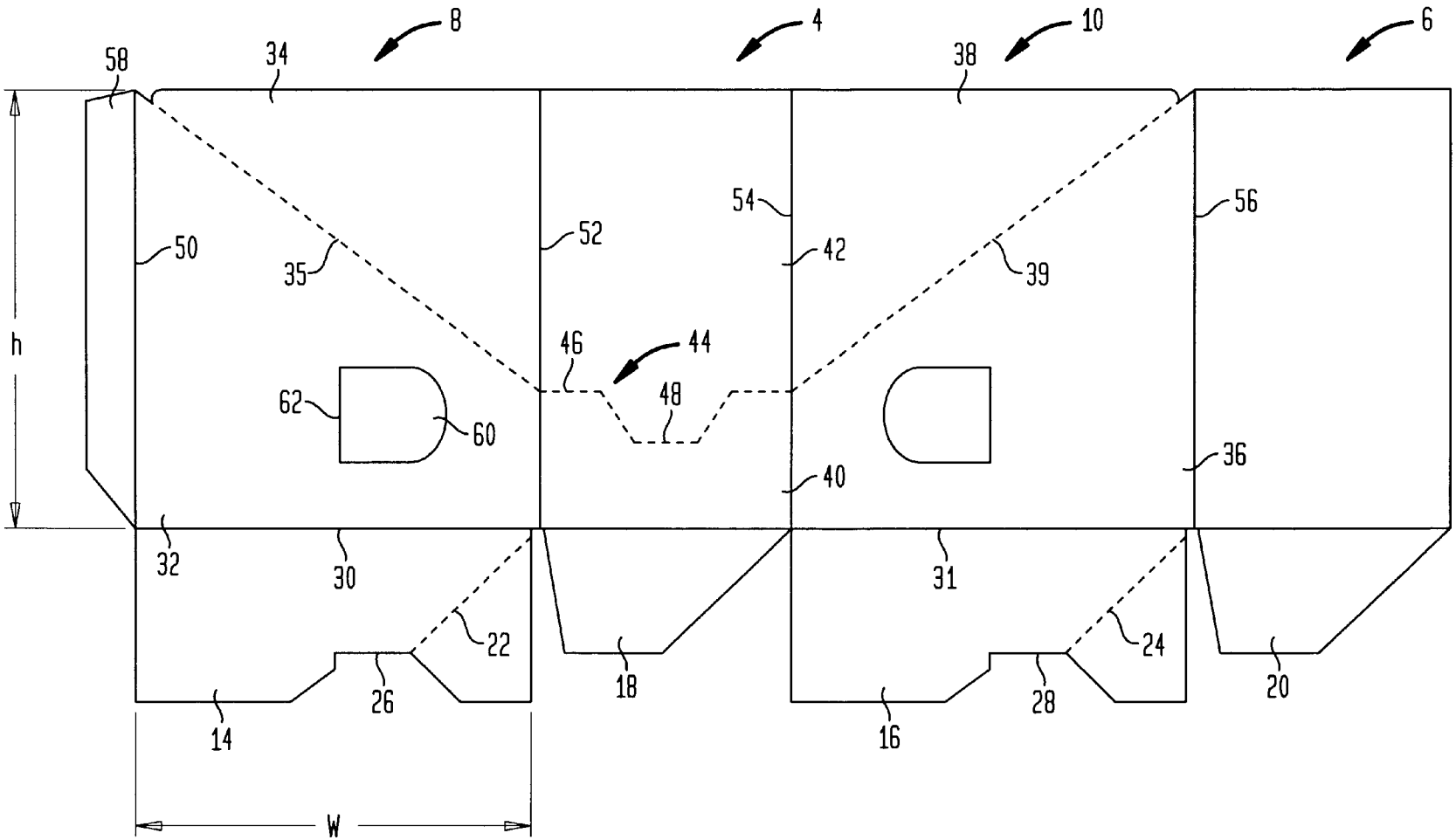
FIG. 2 is a top plan view of a blank showing the pre-assembled carton.

Assembly of the carton is best considered through view of the blank illustrated by FIG. 2. The carton is folded all in the same direction along its four fold lines 50, 52, 54 and 56. Securement flap 58 is glued on its outer wall to an inner wall of rear panel 6. Concomitant with joinder of the front, rear and side panels, the floor is moved into position. Gusseted panels 14, 16 are bent along their score lines 22, 24 in a manner allowing the left and right engagement panels 18, 20 to interlock in alternate arrangement with respective engagement notches 26, 28. Interlocking of panels forming the floor obviate the need for a glued bottom thereby rendering assembly quick without requiring the extra machinery and step involved in an adhesive system.

One or more support tabs 60 may be formed in each of the display wall sections of the side panels. The support tabs are cut along all but a single edge, the latter serving as a hinge fold 62 allowing the support tab to move inward interfering with any of the product packages which may be leaning toward the front panel in danger of toppling out from the display carton.

Figure 3:
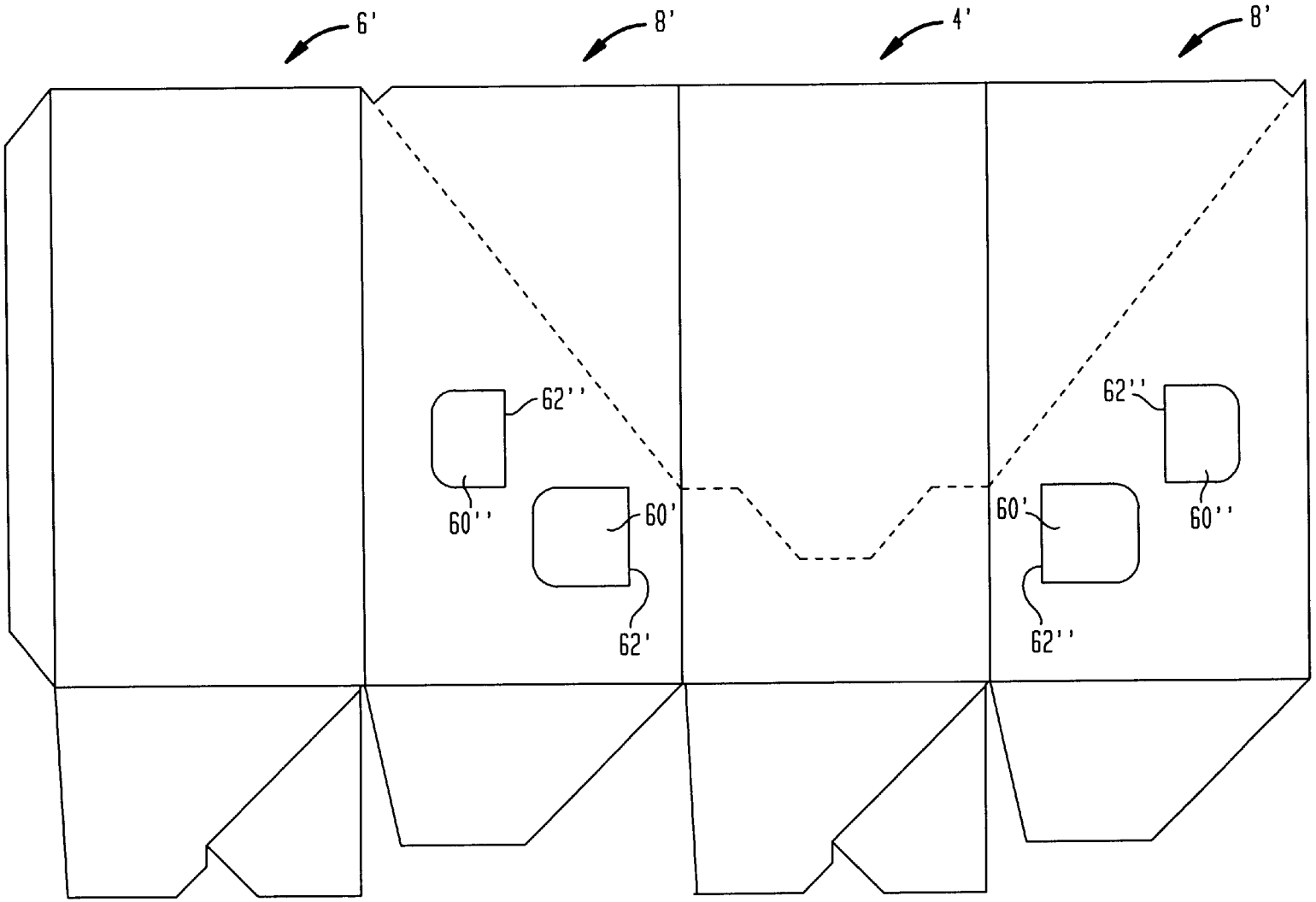
FIG. 3 is a top plan view of a blank showing a second embodiment of the pre-assembled carton.

FIG. 3 illustrates a second embodiment of the support tab feature. Support tabs 60' and 60" are formed in each of the display wall sections of the side panels 8'. Similar to FIG. 2, the support tabs are cut along all but a single edge, the latter serving as a hinge 62', 62" allowing the support tab to move inward interfering with any of the product packages which may be leaning toward the front panel in danger of toppling out from the display carton. As shown in FIG. 3, it is preferred to vertically stagger the support tabs 60' and 60". Multiple tabs and vertical staggering are features which further improve the anti-toppling effect of the display carton. Other embodiments may have support tabs which alternate in the direction in which the tab folds inward (e.g. alternating between a 60 and a 60' oriented tab). Multiple tabs may be employed, preferably ranging between 1 and 10, but optimally between 1 and 3 tabs per display carton.

In one embodiment of this invention, the side panels have a height h greater than a width w of the respective side panel. The height ratio of h to w may range from about 1 to about 3, preferably from about 1.2 to about 2.5 in length. Other embodiments of this invention can allow for a significantly different height ratio depending on the type of product packages required to be displayed and the type of available shelf space. Thus, a second embodiment may employ a height h less than a width w of the respective side panel. Height ratios for this embodiment may range from about 0.2 to about 0.9. Finally, there is possible an embodiment where the height ratio of h to w is approximately 1.

It should be understood that the specific embodiments of the present invention herein illustrated and described are intended to be representative only and that changes may be made therein without departing from the clear teachings of the disclosure. Accordingly, reference should be made to the following appended claims in determining the full scope of the invention.

What is claimed is:

1. A display carton comprising:

opposing front and rear panels;

a floor defined by at least one panel;

a pair of opposing side panels;

the front, rear and side panels having walls of identical height as measured from the floor up to an upper edge of each of the respective panels, the panels forming a receiving cavity and the upper edges defining an open mouth, the side panels each including a tear-away section, one edge of each of the tear-away sections being coincident with the upper edge of the respective side panel and a diagonal edge in perforated attachment running transverse across each of the side panels, and the front panel including a tear-away section having one edge coincident with the upper edge of the front panel and having an opposed edge in perforated attachment; and at least two support tabs each of which are cut-out on at least one of the side panels, the support tabs being attached to the at least one of the side panels along a respective one of at least two hinge folds allowing the respective tab to be positioned within the cavity of the carton, the tabs being vertically offset in a staggered relationship one to the other.

2. The carton according to claim 1 wherein the opposed edge in perforated attachment is non-linear.

3. The carton according to claim 2 wherein the non-linear opposed edge is formed as a pair of horizontal sections joined in a middle area by a trough section.

4. The carton according to claim 1 wherein the floor comprises left and right gusseted panels each including a score line for bending into an interlocking arrangement with left and right engagement panels.

5. The carton according to claim 4 wherein each of the gusseted panels includes an engagement notch intersected by the respective score line.

6. A storage and display carton for two or more individually wrapped personal care product packages comprising:

two or more individually wrapped personal care product packages, the packages having an outer flexible walled wrapping surrounding a plurality of towelettes; and a display carton comprising:

opposing front and rear panels;

a floor defined by at least one panel;

a pair of opposing side panels;

the front, rear and side panels having walls of identical height as measured from the floor up to an upper edge of each of the respective panels, the panels forming a receiving cavity and the upper edges defining an open mouth, the side panels including a tear-away section, one edge of each of the tear-away sections being coincident with the respective side panel and a diagonal edge in perforated attachment running transverse across each of the side panels, and the front panel including a tear-away section having one edge coincident with the upper edge of the front panel and having an opposed edge in perforated attachment; and at least two support tabs each of which are cut-out on at least one of the side panels, the support tabs being attached to the at least one of the side panels along a respective one of at least two hinge folds allowing the respective tab to be positioned within the cavity of the carton, the tabs being vertically offset in a staggered relationship one to the other.

7. The carton according to claim 6 wherein the opposed edge in perforated attachment is non-linear.

* * * * *